United States Patent [19]

Shimamura et al.

[11] 4,162,161

[45] Jul. 24, 1979

[54] REVERSAL COLOR PHOTOGRAPHIC PROCESS

[75] Inventors: Isao Shimamura; Yasuharu Nakamura, both of Minami-ashigara, Japan

[73] Assignee: Fuji Photo Film Co., Ltd., Minami-ashigara, Japan

[21] Appl. No.: 822,764

[22] Filed: Aug. 8, 1977

[30] Foreign Application Priority Data

Aug. 6, 1976 [JP] Japan ..... 51-94375

[51] Int. Cl.[2] ..... G03C 5/50

[52] U.S. Cl. ..... 96/59; 96/22; 96/66 R

[58] Field of Search ..... 96/22, 59, 66

[56] References Cited

U.S. PATENT DOCUMENTS

| | | | |
|---|---|---|---|
| 3,617,282 | 11/1971 | Bard | 96/22 |
| 3,933,427 | 1/1976 | Bohnsack | 252/87 |
| 4,083,723 | 4/1978 | Shimamura et al. | 96/66.5 |

FOREIGN PATENT DOCUMENTS

| | | | |
|---|---|---|---|
| 1045373 | 12/1958 | Fed. Rep. of Germany | 96/66.4 |
| 2001257 | 4/1971 | Fed. Rep. of Germany | 96/59 |
| 125956 | 7/1971 | Japan | 96/59 |
| 1282078 | 7/1972 | United Kingdom . | |

*Primary Examiner*—Mary F. Kelley

*Attorney, Agent, or Firm*—Sughrue, Rothwell, Mion, Zinn and Macpeak

[57] ABSTRACT

A reversal color photographic process which comprises subjecting an exposed silver halide color photographic light-sensitive material to a first black-and-white development and then (a) color developing the light-sensitive material with a color developing solution containing a water-soluble stannous salt and a phosphonocarboxylic acid compound or (b) processing the light-sensitive material with a fogging bath containing a water-soluble stannous salt and a phosphonocarboxylic acid compound and then color developing the light-sensitive material, the phosphonocarboxylic acid compound being represented by the general formula (I):

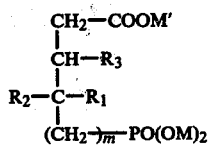

(I)

wherein $R_1$ is —COOM' or —PO(OM)$_2$;

$R_2$ is a hydrogen atom, an alkyl group containing 1 to 4 carbon atoms, —(CH$_2$)$_n$COOM' or a phenyl group;

$R_3$ is a hydrogen atom or —COOM';

M and M', which may be the same or different, each is a hydrogen atom, an alkali metal atom or an ammonium group;

m is 0 or 1; and n is 1 to 4.

9 Claims, No Drawings

REVERSAL COLOR PHOTOGRAPHIC PROCESS

BACKGROUND OF THE INVENTION

1. Field of the Invention

The present invention relates to an improvement in a process for obtaining color photographic images by reversal color photographic processing. Particularly, it relates to an improvement in the fogging bath used in reversal color photographic processing.

2. Description of the Prior Art

Reversal color photographic processing essentially involves the following four steps.

(1) First development.
(2) Fogging treatment.
(3) Color development.
(4) Silver removal.

In the first development in the above-described processing, silver halide having a latent image formed by exposure to light is developed. In the color development, the silve halide which was not developed in the first development is developed in the presence of color couplers to form color images. In the silver removal, developed silver formed in the first development and the second development is oxidized and removed from the photographic light-sensitive material by a fixing agent. The fogging treatment means processing the silve halide grains to provide development nuclei therein so that the silver halide which was not developed in the first development is sufficiently reduced to form dye images.

In order to carry out the fogging processing, although sufficient uniform exposure of the photographic material to light is sometimes used, chemical fogging is often carried out by processing the photographic material using a fogging bath containing a fogging agent or incorporating a fogging agent in the color developing solution. In the latter case, the two steps of the fogging treatment and the color development are carried out at the same time. As chemical fogging agents, alkali metal borohydrides are described in U.S. Pat. No. 2,984,567 and ionic ammonium borohydrides are described in U.S. Pat. No. 3,246,987.

However, since alkali metal borohydrides are unstable in aqueous solutions, the fogging effect of the fogging bath or the color developing solution including the alkali metal borohydrides disappears with the lapse of time. Although the amino borane compounds described in U.S. Pat. No. 3,246,987 do not have this defect, much care must be taken in handling these compounds because they are quite poisonous.

A fogging bath or a color developing solution containing stannous aminopolycarboxylic acid chelate compounds or stannous organic phosphonic acid chelate compounds or stannous organic phosphonic acid chelate compounds is described in U.S. Pat. Nos. 3,658,535 and 3,617,282.

However, these fogging agents are not sufficiently stable in aqueous solutions and are decomposed in the fogging bath or the color developing solution. Consequently, their fogging function deteriorates within a comparatively short period of time even if they are added to the solution in an excess amount.

SUMMARY OF THE INVENTION

A first object of the present invention is to provide a method of reversal color photographic processing which comprises using a novel fogging agent having a low toxicity which is stable in a fogging bath (reversal bath) or a color developing solution.

A second object of the invention is to provide color processing solutions containing the above-described fogging agent.

A third object of the invention is to provide a method which comprises processing photographic light-sensitive materials with the above-described processing solution by which silver halide in the photographic light-sensitive materials become capable of being developed.

A fourth object of the invention is to provide a method of obtaining sharp reversal color images which comprises processing image-wise exposed photographic light-sensitive materials using a processing solution containing the above-described novel fogging agent.

As a result of various studies, it has now been found that the above-described objects of the present invention are attained by using phosphonocarboxylic acid tin (II) chelates as fogging agents.

Accordingly, this invention provides a method of forming a photographic image using a reversal color photographic process which comprises subjecting an exposed silver halide color photographic light-sensitive material to a first black-and-white development and then (a) color developing the light-sensitive material using a color developing solution containing a water-soluble stannous salt and a phosphonocarboxylic acid compound; or (b) processing the light-sensitive material with a fogging bath containing a water-soluble stannous salt and a phosphonocarboxylic acid compound and then color developing the light-sensitive material; in which the phosphonocarboxylic acid compound is represented by the general formula (I):

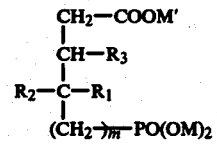

(I)

wherein $R_1$ is —COOM' or —PO(OM)$_2$;

$R_2$ is a hydrogen atom, an alkyl group containing 1 to 4 carbon atoms, —(CH$_2$)$_n$COOM' or a phenyl group;

$R_3$ is a hydrogen atom or —COOM';

M and M', which may be the same or different, each is a hydrogen atom, an alkali metal atom or an ammonium group;

m is 0 or 1; and n is 1 to 4.

DETAILED DESCRIPTION OF THE INVENTION

Although aminopolycarboxylic acid tin (II) chelates (e.g., as disclosed in Japanese Patent Publication 36,835/71) and organic phosphonic acid tin (II) chelates (e.g., as disclosed in Japanese Patent Publication 43,138/73, corresponding to U.S. Pat. No. 3,617,282) are known as fogging agents using tin (II) chelates, neither of these classes of compounds has sufficient stability in acid solutions or alkaline solutions and consequently color development cannot be effectively carried out when they are added to the fogging bath or the color developing solution.

The phosphonocarboxylic acid tin (II) chelates used in the present invention are not only different from aminopolycarboxylic acid tin (II) chelates in terms of chemical structure but also are different from organic phosphonic acid tin (II) chelates from the standpoint of having carboxylic acid groups in their chemical structure. Further, the stability of phosphonocarboxylic acid tin (II) chelates in acid solutions or alkaline solutions is superior to that of aminopolycarboxylic acid tin (II) chelates or organic phosphonic acid tin (II) chelates and, consequently, color development can be effectively carried out to obtain sharp images having a high image density.

Further, the phosphonocarboxylic acid tin (II) chelates used in the present invention are economically advantageous because they have a very lox toxicity and a low price as compared with aminoboranes.

The phosphonocarboxylic acid tin (II) chelates used in the present invention can be easily produced by reacting a water-soluble tin (II) salt with a phosphonocarboxylic acid compound or a water-soluble salt thereof. The thus-obtained chelates can be added to a fogging bath or, when preparing the fogging bath, the water-soluble tin (II) salt and the phosphonocarboxylic acid compound or water-soluble salt thereof can be added separately. Preferably, the water-soluble tin (II) salt and the phosphonocarboxylic acid compound or water-soluble salt thereof are added as an aqueous solution thereof. The term "phosphonocarboxylic acid tin (II) chelates" is used herein in a broad sense to describe such tin (II) chelates preprepared and then used or prepared in situ.

Examples of water-soluble stannous salts suitable for producing phosphonocarboxylic acid tin (II) chelates used in the present invention include stannous chloride, stannous bromide, stannous fluoride, stannous acetate, stannous sulfate and stannous tartarate, etc. Mixtures of these salts can also be used.

The phosphonocarboxylic acid compounds suitable for producing phosphonocarboxylic acid tin (II) chelates used in the present invention are represented by the following general formula (I):

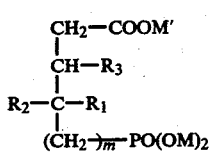

(I)

wherein $R_1$ is —COOM' or —PO(OM)$_2$;

$R_2$ is a hydrogen atom, an alkyl group containing 1 to 4 carbon atoms (such as a methyl group, an ethyl group, an n-propyl group, an isopropyl group, an n-butyl group, an isobutyl group and a tert-butyl group), —(CH$_2$)$_n$COOM' or a phenyl group;

$R_3$ is a hydrogen atom or —COOM';

M and M', which may be the same or different, each is a hydrogen atom, an alkali metal atom (such as Na, K, Li) or an ammonium group;

m=0 or 1; and n=1 to 4. It is preferred for $R_2$ to represent a hydrogen atom, a methyl group or a carboxymethyl group.

Specific examples of compounds represented by the formula (I) include the following compounds.

(1) 1-Phosphonopropane-1,2,3-tricarboxylic acid
(2) 1-Phosphonobutane-2,3,4-tricarboxylic acid
(3) 1,1-Diphosphonopropane-2,3-dicarboxylic acid
(4) 2-Phosphonobutane-2,3,4-tricarboxylic acid
(5) 2,2-Diphosphonobutane-3,4-dicarboxylic acid
(6) 2-Phosphonobutane-1,2,4-tricarboxylic acid The phosphonocarboxylic acid compounds described above suitable for producing the phosphonocarboxylic acid tin (II) chelates in the present invention are merely exemplary and the present invention is not to be construed to be limited to phosphonocarboxylic acid tin (II) chelates prepared from the above-described compounds.

These compounds are described in Japanese Patent Application (OPI) 49,887/74 (corresponding to U.S. Pat. No. 3,933,427) where another use thereof as a water softener is disclosed. A process for synthesizing these compounds is described in U.S. Pat. No. 3,923,876 and 3,886,205.

The amount of the phosphonocarboxylic acid tin (II) chelates which is used in the present invention cannot be set forth unequivocally, because the amount depends on the silver content of silver halide in the color photographic material. However, the phosphonocarboxylic acid tin (II) chelates are preferably used in a range of about 10 mg to about 50 g, preferably 50 mg to 20 g, and particularly 100 mg to 10 g per liter of the processing solution (fogging bath).

In order to control the pH of the solution containing the phosphonocarboxylic acid tin (II) chelates used in the present invention, one or more acids such as hydrochloric acid, sulfuric acid, phosphoric acid, acetic acid, citric acid, tartaric acid, or malic acid, etc., or alkali agents such as sodium hydroxide, potassium hydroxide, lithium hydroxide, sodium carbonate, potassium carbonate, sodium tertiary phosphate, potassium tertiary phosphate, sodium metaborate, potassium metaborate, borax or ammonium hydroxide, etc., may be added. Further, it is possible to add water softeners such as aminopolycarboxylic acids or polyphosphoric acid salts or swelling inhibitors (for example, inorganic salts such as sodium sulfate) to the fogging bath. In addition, if desired, alkalis or other salts may be added in order to provide a buffering salt function.

The pH of the fogging bath may vary widely from acidic to alakline and a suitable pH range is about 2 to about 12, preferably 2.5 to 10 and particularly 3 to 9.

The pH of the developing solution when the phosphonocarboxylic acid tin (II) chelate is present in the developing solution can range from about 8 to about 13, preferably 9 to 12 and particularly 9.5 to 11.5.

The fogging treatment can be conducted at the following points in the processing of the color photographic material.

(a) Fogging treatment before color development:

The fogging bath is a solution containing at least one of the above-described stannous salts and at least one of the compounds represented by the general formula (I) and having a pH of about 2 to about 12 and preferably a pH of 2.5 to 10. A particularly preferred pH is in a range of 3 to 9.

The stannous ion content in the fogging bath is in the range of about $10^{-3}$ to about $2\times10^{-2}$ mole/l and preferably $2\times10^{-3}$ to $1.5\times10^{-2}$ mole/l. The content of the compounds represented by the general formula (I) above is in the range of about $10^{-3}$ to about $4\times10^{-1}$ mole/l and preferably $2\times10^{-3}$ to $1.5\times10^{-1}$ mole/l. It is preferred for the compounds represented by the general formula (I) to be present in an amount in a range of about 1 to about 10 molar times based on the amount of the stannous ion.

In order to carry out the color development, color developing solutions conventionally used for reversal color photographic treatment may be used.

(b) Addition of the fogging agent of the present invention to the color developing solution:

where the fogging agent of the present invention is added to the color developing solution, it is not necessary for the fogging treatment to be conducted before the color development. The color developing solution has the same composition and pH as those conventionally used for reversal color photographic treatments except that at least one of the stannous salts and at least one of the compounds represented by the general formula (I) are present in the color developing solution. Namely, the color developing solution is a solution containing an aromatic primary amine as a developing agent and having a pH of about 8 to about 13.

The amounts of the stannous ion and the compounds represented by the general formula (I) present in the color developing solution are the same as in the cases of the fogging bath described above.

The color developing solution used in the present invention has a composition which is the same as that of a conventional color developing solution containing an aromatic primary amine developing agent. A suitable amount of the color developing agent which can be used in the color developing solution ranges from about 0.1 to about 50 g/l, preferably 1 to 30 g/l. Preferred examples of aromatic primary amine developing agents include the following p-phenylenediamine derivatives. Namely, preferred typical examples include N,N-diethyl-p-phenylenediamine, 2-amino-5-diethylaminotoluene, 2-amino-5-(N-ethyl-N-laurylamino)toluene, 4-[N-ethyl-N-(β-hydroxyethyl)amino]aniline, 2-methyl-4-[N-ethyl-N-(β-hydroxyethyl)amino]aniline, N-ethyl-N-(β-methanesulfoamidoethyl)-3-methyl-4-aminoaniline, N-(2-amino-5-diethylaminophenylethyl)methanesulfonamide, N,N-dimethyl-p-phenylenediamine, 4-amino-3-methyl-N-ethyl-N-methoxyethylaniline, 4-amino-3-methyl-N-ethyl-N-βethoxyethylaniline and 4-amino-3-methyl-N-ethyl-N-β-butoxyethylaniline or the salts thereof (for example, sulfates, hydrochlorides, sulfites or p-toluenesulfonates, etc.), etc., as described in U.S. Pat. Nos. 3,656,950 and 3,698,525.

The color developing solution may contain other known compounds as developing solution components. For example, as alkali agents or buffering agents, sodium hydroxide, potassium hydroxide, sodium carbonate, potassium carbonate, sodium tertiary phosphate, potassium tertiary phosphate, potassium metaborate or borax, etc., can be used individually or as a combination of two or more thereof. Further, in order to provide a buffer function thereto, for reasons of preparation or for the purpose of increasing the ionic strength, various kinds of salts such as disodium hydrogen phosphate, dipotassium hydrogen phosphate, potassium dihydrogen phosphate, sodium dihydrogen phosphate, sodium bicarbonate, potassium bicarbonate, alkali metal borates, alkali metal nitrates or alkali metal sulfates, etc., can be used.

It is possible to add sulfite (for example, sodium sulfite, potassium sulfite, potassium bisulfite or sodium bisulfite) or hydroxylamine, which are conventionally used as preservatives, to the color developing solution.

If desired, suitable development accelerating agents may be added to the color developing solution. For example, it is possible to use various pyridinium compounds or other cationic compounds, cationic dyes such as phenosafranine and neutral salts such as thallium nitrate or potassium nitrate, as described in U.S. Pat. No. 2,648,604, Japanese Patent Publication 9,503/69 and U.S. Pat. No. 3,671,247, nonionic compounds such as polyethylene glycol or derivatives thereof or polythioethers described in Japanese Patent Publication 9,504/69, U.S. Pat. Nos. 2,531,832, 2,950,970 and 2,577,127, organic solvents or organic amines, ethanolamine, ethylenediamine or diethanolamine, as described in Japanese Patent Publication 9,509/69 and Belgian Patent 682,862 and accelerating agents described in L.F.A. Mason, *Photographic Processing Chemistry,* pages 40–43, Focal Press, London (1966). Further, benzyl alcohol or phenylethyl alcohol described in U.S. Pat. No. 2,515,147 or pyridine, ammonia, hydrazine and amines described in *Nippon Shashin Gakkaishi,* Vol. 14, page 74 (1952) are also useful.

In addition, calcium or magnesium sequestering agents may be used in the color developing solution. These agents are described in J. Willems, *Belgische Chemische Industrie,* Vol. 21, page 325 (1956) and ibid., Vol. 23, page 1105 (1958).

It is also possible to add competitive couplers or compensating developing agents to the color developing solution.

Useful competitive couplers include citrazinic acid, J-acid and H-acid, etc. For example, the compounds described in U.S. Pat. No. 2,742,832, Japanese Patent Publications 9,504/69, 9,506/69 and 9,507/69 and U.S. Pat. Nos. 3,520,690, 3,560,212 and 3,645,737, etc., can be used.

Examples of compensating developing agents which can be used are p-aminophenol, N-benzyl-p-aminophenol and 1-phenyl-3-pyrazolidone, etc. For example, the compounds described in Japanese Patent Publications 41,475/66 and 19,037/71 are useful.

It is preferred for the pH of the developing solution to range from about 8 to about 13. The temperature at which the color development and/or processing with the fogging bath is conducted can range from about 20° C. to about 70° C. and a preferred temperature is about 30° C. to about 60° C.

The photographic emulsion layers after color development are generally subjected to a bleaching treatment. The bleaching may be carried out simultaneously with fixing or may be carried out separately. Examples of bleaching agents include compounds of polyvalent metals such as iron (III), cobalt (IV), chromium (VI) or copper (II), etc., peracids, quinones and nitroso compounds, etc. For example, it is possible to use ferricyanides, bichromates, organic complex salts of iron (III) or cobalt (III), complex salts of aminopolycarboxylic acids such as ethylenediaminetetraacetic acid, nitrilotriacetic acid or 1,3-diamino-2-propanol tetraacetic acid, etc., or organic acids such as citric acid, tartaric acid or malic acid, etc.; persulfates, permanganates and nitrosophenol, etc. Of these compounds, potassium ferricyanide, sodium iron (III) ethylenediaminetetraacetate and ammonium iron (III) ethylenediaminetetraacetate are particularly preferred. Aminopolycarboxylic acid iron (III) complex salts are useful not only for the bleaching solution but also a mono-bath bleach-fixing solution.

It is also possible to add to the bleaching solution or the bleach-fixing solution not only bleach accelerating agents as described in U.S. Pat. Nos. 3,042,520 and 3,241,966 and Japanese Patent Publications 8,506/70 and 8,836/70 but also various other additives.

The process of the present invention can not only be utilized for a color photographic process wherein dye forming couplers are incorporated in the light-sensitive materials, such as the process as described in U.S. Pat. Nos. 2,322,027, 2,376,679 and 2,801,171 but also applied to a color photographic process wherein a coupler is included in the developing solution, such as the process as described in U.S. Pat. Nos. 2,252,718, 2,590,970 and 2,592,243.

At the present time, however, the former process is mainly utilized. Where the dye forming couplers are incorporated in the light-sensitive materials, multilayer light-sensitive materials are generally used and it is therefore desired for the couplers to remain in a specific layer and not to diffuse into other layers during the preparation, storage or processing of the light-sensitive material.

The color photographic process of the present invention can be utilized for a diffusion transfer color photographic process wherein the process described in U.S. Pat. Nos. 3,227,551 or 3,227,552 is used.

In the photographic process of the present invention, suitable known couplers can be used as couplers for forming dye images. The couplers used may be any 4-equivalent type and 2-equivalent type couplers. The couplers may be colored couplers for color correction, colorless couplers or couplers which release a development inhibitor during development (the so-called DIR couplers).

Known open-chain ketomethylene type couplers may be used as yellow couplers. Benzoylacetanilide type compounds and pivaloylacetanilide type compounds are advantageously used as yellow couplers. Examples of yellow couplers which can be used include the compounds described in U.S. Pat. Nos. 2,875,057, 3,265,506, 3,408,194, 3,551,155, 3,582,322, 3,725,072 and 3,894,875, German Patent Publication (DAS) 1,547,868 and German Patent Applications (OLS) 2,213,461, 2,219,917, 2,261,361, 2,263,875 and 2,414,006, etc.

5-Pyrazolone type compounds are mainly used as magenta couplers, but imidazolone type compounds and cyanoacetyl compounds may be used as well. Examples of suitable magenta couplers include the compounds described in U.S. Pat. Nos. 2,600,788, 2,983,608, 3,062,653, 3,127,269, 3,311,476, 3,419,391, 3,476,560, 3,519,429, 3,558,319, 3,582,322 and 3,615,506, German Pat. (DAS) 1,810,464, German Patent Applications (OLS) 2,408,665, 2,418,959 and 2,424,467 and Japanese Pat. Publications 6,031/65 and 2,016/69, etc.

Phenol or naphthol derivatives are mainly used as cyan couplers. Examples of cyan couplers include the compounds described in U.S. Pat. Nos. 2,369,929, 2,434,272, 2,474,293, 2,521,908, 2,895,826, 3,034,892, 3,311,476, 3,386,830, 3,458,315, 3,476,563, 3,583,971 and 3,591,383 and Japanese Patent Application (OPI) 78,905/73.

In addition, development inhibitor releasing type couplers (the so-called DIR couplers) or compounds which release a development inhibiting compound in the coupling reaction may also be used. Examples of these compounds include the compounds described in U.S. Pat. Nos. 3,227,554, 3,617,291, 3,632,345, 3,701,783 and 3,790,384, British Pat. No. 953,454, German Pat. Applications (OLS) Nos. 2,414,006, 2,417,914, 2,417,945, 2,454,301 and 2,454,329 and U.S. Pat. Nos. 3,297,445 and 3,379,529, etc.

Further, the couplers described in Japanese Pat. Application Nos. 37,651/74, 99,617/74, 66,378/74, 92,685/74, 98,469/74, 114,445/74, 1,792/75, 70,592/75, 96,435/75, 118,029/75 and 118,540/75 can be used.

Two or more of the above-described couplers may be incorporated in a single layer in order to achieve the properties required for the light-sensitive material. Alternatively, a single compound may be incorporated into two or more different layers.

These couplers are generally dispersed in silver halide photographic emulsion layers together with solvents having a suitable polarity. Examples of useful solvents include tri-o-cresylphosphate, trihexyl phosphate, dioctylbutyl phosphate, dibutyl phthalate, diethyllaurylamide, 2,4-diallylphenol and octylbenzoate, etc.

The color photosensitive materials photographically processed by the process of the present invention are those which comprise at least one silver halide emulsion layer on a support. Generally, such materials have a red-sensitive silver halide emulsion layer, a green-sensitive silver halide emulsion layer and a blue-sensitive silver halide emulsion layer. Further, the materials, in general, have at least one red-sensitive silver halide emulsion layer containing a cyan image forming coupler, at least one green-sensitive silver halide emulsion layer containing a magenta image forming coupler and at least one blue-sensitive silver halide emulsion layer containing a yellow image forming coupler on a support. Such photographic elements may also contain non-light-sensitive photographic layers (for example, an antihalation layer, an intermediate layer(s) for inhibiting color mixing, a filter layer or a protective layer, etc.). The red-sensitive layer, the green-sensitive layer and the blue-sensitive layer may be arranged in any order on the support.

Any of silver bromide, silver chloride, silver bromochloride, silver bromoiodide and silver iodobromochloride may be used as the silver halide in the photographic emulsion layers of the color photosensitive materials photographically processed by the process of the present invention. Where two or more photographic emulsion layers are present, combinations of two or more different silver halides may be used. The photographic emulsions can be produced using known methods, for example, the process described in P. Grafkides, *Chimie Photographique*, Paul Montel Co., Paris (1967) and the silver halides may be produced by any of an ammonia process, a neutral process, a double jet process and a controlled double jet process.

The grains of these silver halides may have any crystal form such as a cubic form, an octahedral form or a mixed crystal form thereof, etc.

The fogging agents used in the present invention are more stable by far in aqueous solutions than the borohydride compounds described in U.S. Pat. Nos. 2,984,567 and 3,554,748. The fogging agents of this invention are further more stable in aqueous solutions than the stannous aminopolycarboxylic acid chelate compounds described in U.S. Pat. No. 3,658,535 or the organic phosphonic acid chelate compounds described in U.S. Pat. No. 3,617,282. Namely, the fogging function of the fogging bath or the developing solution containing the fogging agent used in this invention is stable for a long period of time.

Further, the fogging agents used in the present invention are not toxic unlike the aminoborane compounds described in U.S. Pat. No. 3,246,987.

The stannous salts and compounds represented by the formula (I) used to produce the phosphonocarboxylic acid tin (II) chelates in the present invention are inexpensive. Accordingly, these compounds are more advantageous from this standpoint than aminoboranes, aminopolycarboxylic acids or organic phosphonic acids.

The present invention is illustrated in detail by reference to the following examples. Unless otherwise indicated, all parts, percents, ratios and the like are by weight.

EXAMPLE 1

To a red-sensitive silver iodobromide emulsion (silver iodide: 7% by mole), 1-hydroxy-4-chloro-2-n-dodecylnaphthamide was added as a cyan coupler. To a green-sensitive silver iodobromide emulsion (silver iodide: 6% by mole), 1-(2',4',6'-trichlorophenyl)-3-[3''-(2''',4'''-di-t-amylphenoxyacetamido)benzamido]-5-pyrazolone was added as a magenta coupler. To a blue-sensitive silver iodobromide emulsion (silver iodide: 6% by mole), α-pivaloyl-α-[4-(4-benzyloxysulfonyl)phenoxy]-2-chloro-5-[γ-(2,4-di-t-amylphenoxy)-butyramido]acetanilide was added as a yellow coupler. The resulting emulsions were coated in turn on a cellulose triacetate film to produce a color photographic light-sensitive material.

For emulsification of each coupler in the above case, dibutylphthalate and tricresylphosphate were used as solvents for the couplers, sorbitan monolaurate and sodium dodecylbenzene sulfonate were used as emulsifiers and sodium 1-(p-nonylphenoxytrioxyethylene)butane-4-sulfonate and the lauric acid ester of sucrose were added as coating aids.

Each sample had a filter layer comprising yellow colloidal silver positioned between the green-sensitive silver halide emulsion layer and the blue-sensitive silver halide emulsion layer, an intermediate layer composed of gelatin containing di-t-amylhydroquinone positioned between the green-sensitive silver halide emulsion layer and the red-sensitive silver halide emulsion layer, and a protective layer composed mainly of gelatin positioned on the blue-sensitive silver halide emulsion layer.

After exposure to light through a light wedge, each film was processed as follows.

| | Temperature (°C.) | Time (minutes) |
|---|---|---|
| First Development (black-and-white) | 30 | 5 |
| Stopping | " | 1 |
| Water Wash | " | 2 |
| Color Development | " | 7 |
| Stopping | " | 2 |
| Hardening Bath | " | 2 |
| Water Wash | " | 2 |
| Bleaching Bath | " | 4 |
| Water Wash | " | 2 |
| Fixing Bath | " | 4 |
| Water Wash | " | 2 |
| Drying | " | |

| First Developing Solution: | | |
|---|---|---|
| Sodium Sulfite | 60 | g |

-continued

| | | |
|---|---|---|
| 1-Phenyl-3-pyrazolidone | 0.3 | g |
| Hydroquinone | 5.0 | g |
| Sodium Carbonate (monohydrate) | 41 | g |
| Potassium Bromide | 2.0 | g |
| Potassium Iodide (1% aq. soln.) | 1.0 | ml |
| Potassium Thiocyanate (1 N aq. soln.) | 10 | ml |
| Sodium Hydroxide (10% aq. soln.) | 2.0 | ml |
| Water to make | 1 | l |
| Stopping Solution: | | |
| Sodium Acetate | 30 | g |
| Glacial Acetic Acid | 8 | ml |
| Water to make | 1 | l |

Color Developing Solution:

The components set forth below were employed in the amounts set forth below to prepare, with the additional components described in the table below, Color Developing Solutions A to F with water to make 1 liter being added to each of Color Developing Solutions A to F.

| | | |
|---|---|---|
| Benzyl Alcohol | 5 | ml |
| Sodium Hydroxide | 0.5 | g |
| Diethyleneglycol | 3 | ml |
| Sodium Hexametaphosphate | 2 | g |
| Sodium Sulfite | 2 | g |
| Potassium Bromide | 2 | g |
| 4-Amino-3-methyl-N-ethyl-β-hydroxyethylaniline Sesquisulfate (monohydrate) | 5 | g |
| Citrazinic Acid | 0.4 | g |
| Metaboric Acid | 0.5 | g |
| Sodium Metaborate (tetrahydrate) | 77 | g |

| | Color Developing Solution | | | | | |
|---|---|---|---|---|---|---|
| | A | B | C | D | E | F |
| Stannous Chloride* (g) | — | 3 | 3 | 3 | 3 | 3 |
| Disodium Ethylenediaminetetraacetate* (for comparison) (g) | — | — | 20 | — | — | — |
| 1-Hydroxy-ethane-1,1-diphosphoric Acid* (for comparison) (g) | — | — | — | 15 | — | — |
| Compound 2* (the present invention) (g) | — | — | — | — | 20 | — |
| Compound 6* (the present invention) (g) | — | — | — | — | — | 20 |
| Water to make (l) | 1 | 1 | 1 | 1 | 1 | 1 |

*Compounds 2 and 6 of the present invention and disodium ethylenediaminetetraacetate and 1-hydroxy-ethane-1,1-diphosphonic acid for comparison were each added to the color developing solution as an aqueous solution of a mixture with stannous chloride.

| Hardening Bath: | |
|---|---|
| Sodium Hexametaphosphate | 1 g |
| Borax (pentahydrate) | 20 g |
| Formaldehyde (37% aq. soln.) | 10 ml |
| Bleaching Solution: | |
| Sodium Iron (III) Ethylenediaminetetraacetate (dihydrate) | 30 g |
| Potassium Bromide | 50 g |
| Disodium Ethylenediaminetetraacetate | 5 g |
| Boric Acid | 3 g |

The photographic characteristic values obtained after development are shown in Table 1 below. The red density, the green density and the blue density of the maximum density area are shown as the photographic characteristic values. The results obtained by repeating the same procedures as described above but using a developing solution which had been stored in a sealed reagent bottle and allowed to stand at 40° C. for 1 week are also shown in Table 1 below.

Table 1

| Color Developing Solution | Fresh Solution Maximum Density | | | Aged Solution Maximum Density | | |
|---|---|---|---|---|---|---|
| | Blue | Green | Red | Blue | Green | Red |
| A | 2.35 | 1.06 | 0.55 | 2.02 | 0.80 | 1.12 |
| B | 2.90 | 3.01 | 2.81 | 2.43 | 2.56 | 2.27 |
| C | 2.89 | 3.14 | 2.51 | 2.58 | 2.50 | 2.32 |
| D | 3.02 | 3.44 | 2.85 | 2.60 | 2.78 | 2.46 |
| E* | 3.08 | 3.53 | 2.91 | 2.97 | 3.43 | 2.84 |
| F* | 3.12 | 3.47 | 2.94 | 3.02 | 3.35 | 2.81 |

*Present invention

As is clear from the results in Table 1 above, with Color Developing Solution A which contained no fogging agent, the maximum densities of the fresh solution and those of the aged solution were both very low. With Color Developing Solution B which contained only the stannous salt, the maximum densities of the aged solution were low. With Color Developing Solutions C and D which contained a known fogging agent: an aminopolycarboxylic acid tin (II) chelate or an organic phosphonic acid tin (II) chelate, the maximum densities of the aged solution were lower than those of Color Developing Solutions E and F which contained the phosphonocarboxylic acid tin (II) chelates of the present invention. Accordingly, it can be seen that the stability of the phosphonocarboxylic acid tin (II) chelates of the present invention in a color developing solution is excellent.

EXAMPLE 2

After exposing to light a sample prepared as described in Example 1, the same procedures as described in Example 1 were carried out except that a fogging treatment for 1 minute was inserted between the water wash and the color development.

Color Developing Solution A as described in Example 1 which did not contain any fogging agent was used as a color developing solution. Further, solutions having the same composition as in Example 1 were used except that a fogging bath having the following composition was used.

| | Composition of the Fogging Bath | | | | | |
|---|---|---|---|---|---|---|
| | G | H | I | J | K | L |
| Sodium Acetate (g) | 7.2 | 7.2 | 7.2 | 7.2 | 7.2 | 7.2 |
| Stannous Chloride (g) | — | 0.3 | 0.3 | 0.3 | 0.3 | 0.3 |
| Disodium Ethylenediamine-tetraacetate (for comparison) (g) | — | — | 1.5 | — | — | — |
| 1-Hydroxyethane-1,1-di-phosphonic acid (for comparison) (g) | — | — | — | 1.5 | — | — |
| Compound 2 (the present invention) (g) | — | — | — | — | 2 | — |
| Compound 6 (the present invention) (g) | — | — | — | — | — | 2 |
| Glacial Acetic Acid (cc) | 54 | 54 | 54 | 54 | 54 | 54 |
| Water to make (l) | 1 | 1 | 1 | 1 | 1 | 1 |

The photographic characteristic values obtained after development are shown in Table 2 below. The red density, the green density and the blue density of the maximum density area are shown as the photographic characteristic values. The results obtained by repeating the same procedures as described above using a fogging solution which was stored in a sealed reagent bottle and allowed to stand at 40° C. for 1 week are also shown in Table 2 below.

Table 2

| Fogging Bath | Fresh Solution Maximum Density | | | Aged Solution Maximum Density | | |
|---|---|---|---|---|---|---|
| | Blue | Green | Red | Blue | Green | Red |
| G | 2.31 | 1.04 | 1.34 | 2.30 | 1.06 | 1.35 |
| H | 2.88 | 3.30 | 2.80 | 2.25 | 1.52 | 2.30 |
| I | 2.96 | 3.10 | 2.40 | 2.62 | 2.56 | 1.98 |
| J | 3.00 | 3.42 | 2.81 | 2.63 | 2.85 | 2.20 |
| K* | 3.10 | 3.50 | 2.90 | 3.00 | 3.45 | 2.82 |
| L* | 3.15 | 3.52 | 2.91 | 3.08 | 3.46 | 2.86 |

*Present invention

As is clear from the results in Table 2 above, with Fogging Bath G which did not contain any fogging agent, the maximum densities of the fresh solution and those of the aged solution were both very low. With Fogging Bath H where only the stannous salt was included in the fogging bath, white precipitates were formed and the maximum densities of the aged solution were very low. Further, with Fogging Baths I and J which contained an aminopolycarboxylic acid tin (II) chelate or an organic phosphonic acid tin (II) chelate for comparison, the maximum densities of the aged solution were lower than those with Fogging Baths K and L which contained the phosphonocarboxylic acid tin (II) chelates of the present invention. Accordingly, it can be understood that the stability of the phosphonocarboxylic acid tin (II) chelates of the present invention is superior to that of other compounds described above.

While the invention has been described in detail and with reference to specific embodiments thereof, it will be apparent to one skilled in the art that various changes and modifications can be made therein without departing from the spirit and scope thereof.

What is claimed is:

1. A reversal color photographic process in which color development is carried out in the presence of a color coupler which comprises subjecting an imagewise exposed silver halide color photographic light-sensitive material to a first black-and-white development and then (a) color developing said light-sensitive material with a color developing solution containing a p-phenylene diamine or derivative thereof color developer, a water-soluble stannous salt and a phosphonocarboxylic acid compound; or (b) processing said light-sensitive material with a fogging bath containing a water-soluble stannous salt and a phosphonocarboxylic acid compound and then color developing said light-sensitive material with a p-phenylene diamine or derivative thereof color developer, whereby silver halide which was not developed in the first development is developed in the presence of a color coupler to form color images, said phosphonocarboxylic acid compound being represented by the general formula (I):

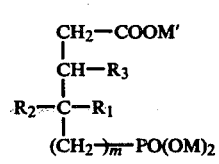

(I)

wherein $R_1$ is —COOM′ or —PO(OM)$_2$;

$R_2$ is a hydrogen atom, an alkyl group containing 1 to 4 carbon atoms, $-(CH_2)_nCOOM'$ or a phenyl group;

$R_3$ is a hydrogen atom or $-COOM'$;

M and M', which may be the same or different, each is a hydrogen atom, an alkali metal atom or an ammonium group;

m is 0 or 1; and n is 1 to 4.

2. The process of claim 1, wherein said water-soluble stannous salt is stannous chloride, stannous bromide, stannous fluoride, stannous acetate, stannous sulfate or stannous tartarate.

3. The process of claim 1, wherein said phosphonocarboxylic acid compound represented by the general formula (I) is 1-phosphonopropane-1,2,3-tricarboxylic acid, 1-phosphonobutane-2,3,4-tricarboxylic acid, 1,1-diphosphonopropane-2,3-dicarboxylic acid, 2-phosphonobutane-2,3,4-tricarboxylic acid, 2,2-diphosphonobutane-3,4-dicarboxylic acid or 2-phosphonobutane-1,2,4-tricarboxylic acid.

4. The process of claim 1, wherein said water-soluble stannous salt is stannous chloride and said phosphonocarboxylic acid compound is 2-phosphonobutane-1,2,4-tricarboxylic acid.

5. The process of claim 1, wherein said fogging bath has a pH of about 2 to about 12, wherein said water-soluble stannous salt is present in said fogging bath in an amount of about $10^{-3}$ to about $2\times10^{-2}$ mole per liter of said fogging bath, and said phosphonocarboxylic acid compound represented by the general formula (I) is present in said fogging bath in an amount of about $10^{-3}$ to about $4\times10^{-1}$ mole per liter of said fogging bath.

6. The process of claim 1, wherein said color developer has a pH of about 8 to about 13, said water-soluble stannous salt is present in said color developer in an amount of about $10^{-3}$ to about $2\times10^{-2}$ mole per liter of said color developer, and said phosphonocarboxylic acid compound represented by the general formula (I) is present in said color developing solution in an amount of about $10^{-3}$ to about $4\times10^{-1}$ mole per liter of said color developing solution.

7. The process of claim 1, wherein said processing with said fogging bath is at a temperature ranging from about 20° to about 70° C. and said processing in said color developing solution is at a temperature ranging from about 20° C. to about 70° C.

8. The process of claim 1 wherein process (a) is used.

9. The process of claim 1 wherein process (b) is used.

* * * * *